US008424321B2

(12) United States Patent
Son et al.

(10) Patent No.: US 8,424,321 B2
(45) Date of Patent: Apr. 23, 2013

(54) REFRIGERATOR HAVING A PLURALITY OF DISPLAY UNITS

(75) Inventors: Hee Soo Son, Busan (KR); Ik Kyu Lee, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 798 days.

(21) Appl. No.: 12/066,815

(22) PCT Filed: Sep. 14, 2006

(86) PCT No.: PCT/KR2006/003650

§ 371 (c)(1),
(2), (4) Date: Oct. 9, 2008

(87) PCT Pub. No.: WO2007/032644

PCT Pub. Date: Mar. 22, 2007

(65) Prior Publication Data

US 2009/0217682 A1 Sep. 3, 2009

(30) Foreign Application Priority Data

| | | |
|---|---|---|
| Sep. 16, 2005 | (KR) | 10-2005-0086978 |
| Sep. 29, 2005 | (KR) | 10-2005-0091263 |
| Oct. 5, 2005 | (KR) | 10-2005-0093520 |
| Oct. 10, 2005 | (KR) | 10-2005-0094997 |

(51) Int. Cl.
*F25B 49/00* (2006.01)

(52) U.S. Cl.
USPC ..... 62/127; 62/125

(58) Field of Classification Search ..... 62/125, 62/127, 246
See application file for complete search history.

(56) References Cited

U.S. PATENT DOCUMENTS

| | | | | |
|---|---|---|---|---|
| 5,978,046 | A * | 11/1999 | Shintani | 348/589 |
| 6,442,952 | B2 * | 9/2002 | Roh et al. | 62/127 |
| 6,587,082 | B1 * | 7/2003 | Moore | 345/1.3 |
| 2001/0010516 | A1 | 8/2001 | Roh et al. | |
| 2001/0039805 | A1 | 11/2001 | Tavolazzi | |
| 2001/0054291 | A1 | 12/2001 | Roh et al. | |
| 2003/0019236 | A1 * | 1/2003 | Heims et al. | 62/338 |
| 2004/0186596 | A1 * | 9/2004 | Roh et al. | 700/19 |
| 2005/0138948 | A1 * | 6/2005 | Lee | 62/331 |
| 2005/0284159 | A1 * | 12/2005 | Kim | 62/126 |

(Continued)

FOREIGN PATENT DOCUMENTS

| | | | |
|---|---|---|---|
| CN | 1330331 | A | 1/2002 |
| JP | 09-054644 | A | 2/1997 |

(Continued)

*Primary Examiner* — Cheryl J Tyler
*Assistant Examiner* — Jonathan Bradford
(74) *Attorney, Agent, or Firm* — Birch, Stewart, Kolasch & Birch, LLP

(57) ABSTRACT

A refrigerator is disclosed which is capable of performing data transmission and reception with an external electric appliance (60), or enabling data transmission and reception among a plurality of display units (30, 40) included in the refrigerator. The refrigerator includes a refrigerator body (10), and a plurality of display units provided at the refrigerator body. Each display unit (30, 40) includes a display for displaying an image or audio data, or data as to a status of the refrigerator, a connector (31, 45) for performing transmission and reception of the data with the remaining display units, and a controller (37, 47) for controlling the data transmission and reception. Since data transmission reception with the external of the refrigerator and in the internal of the refrigerator is possible, an improvement in the convenience of the user is achieved.

23 Claims, 6 Drawing Sheets

U.S. PATENT DOCUMENTS

| | | | | |
|---|---|---|---|---|
| 2006/0001593 | A1* | 1/2006 | Baudisch | 345/1.1 |
| 2006/0090482 | A1* | 5/2006 | Dawes | 62/126 |
| 2008/0024685 | A1 | 1/2008 | Lee | |

FOREIGN PATENT DOCUMENTS

| | | | |
|---|---|---|---|
| JP | 2000-010655 | A | 1/2000 |
| JP | 2003-224891 | A | 8/2003 |
| JP | 2005-140345 | A | 6/2005 |
| KR | 2001-0001242 | U | 1/2001 |
| KR | 10-2001-0113349 | A | 12/2001 |
| KR | 20-0330611 | Y1 | 10/2003 |
| KR | 20-0350983 | Y1 | 5/2004 |
| KR | 10-0484820 | B1 | 4/2005 |
| KR | 10-2005-0049801 | A | 5/2005 |
| KR | 10-2005-0056081 | A | 6/2005 |
| WO | WO 2005107251 | A1 * | 11/2005 |

* cited by examiner

REFRIGERATOR HAVING A PLURALITY OF DISPLAY UNITS

TECHNICAL FIELD

The present invention relates to a refrigerator, and more particularly, to a refrigerator capable of transmitting/receiving and displaying image or audio data.

BACKGROUND ART

Conventionally, there is a refrigerator which is provided with a display such as a light emitting diode (LED) display panel, for provision of information as to the refrigerator and control of the refrigerator. User interfaces are displayed through the display. The user interfaces represent information as to the status of the refrigerator in the form of numerals, text, or icons. The status information may include the temperature of a refrigerating compartment, the temperature of a freezing compartment, the service status of a dispenser such as supply status of water, ice, etc. The refrigerator is also provided with an input unit (for example, buttons) for inputting control signals for controlling the temperatures of the compartments and the service mode of the dispenser.

FIG. 1 is a schematic view illustrating a display included in a conventional refrigerator. As shown in the drawing, the display displays the service mode of a dispenser (supply of ice cubes, water, and crushed ice), a set freezing compartment temperature, and a set refrigerating compartment temperature. Desired input means is provided at a lower portion of the display. Typically, the display has a screen size of 4 inches or less.

DISCLOSURE OF INVENTION

Technical Problem

The above-mentioned conventional refrigerator has the following problems.

First, in the conventional refrigerator, there is no audio output unit for outputting various audio signals from external electric appliances. For this reason, there is a problem in that, when it is desired to listen to such audio signals, it is necessary to provide a separate audio output device.

Second, there is a problem in that information of a limited size can only be displayed through a single display. In other words, it is impossible to simultaneously and individually display various information on divided screen regions of the display.

Third, there is a problem in that the refrigerator cannot perform transmission and reception of data required to edit or control the screen of the display, based on the data.

Technical Solution

An object of the present invention devised to solve the above-mentioned problems lies in providing a refrigerator capable of perform transmission and reception of various data with an external appliance.

Another object of the present invention is to provide a refrigerator which includes a plurality of display units configured to share data, thereby being capable of outputting and editing the data.

The objects of the present invention can be achieved by providing a refrigerator comprising: a refrigerator body; and a plurality of display units provided at the refrigerator body, wherein each of the display units includes: a display for displaying an image or audio data, or data as to a status of the refrigerator; a connector for performing transmission and reception of the data with the remaining display units; and a controller for controlling the data transmission and reception.

Preferably, at least one of the display units further includes an audio output unit for outputting an audio signal.

More preferably, the at least one display unit including the audio output unit comprises a plurality of display units. Also, more preferably, the controller of at least one of the display units each including the audio output unit adjusts distribution of sound components of the audio signal such that the audio signal is output through the audio output unit in a stereo fashion.

At least one of the display units may further include an input unit for receiving a command from a user.

The refrigerator may further comprise an external-appliance connector provided at the refrigerator body, and adapted to perform transmission and reception of data with an external appliance. In this case, the refrigerator body may include a cap for protecting the external-appliance connector.

Preferably, at least one of the display units may further include a storage unit for storing the data. In this case, preferably, the controller of the display unit including the storage unit selectively outputs at least one of the stored data.

At least one of the display units may further include a data editor for editing the stored data. For example, the data editor can set the stored image data as a background image.

Preferably, the refrigerator comprises a first display unit including a first display, a broadcast receiver for receiving a broadcast signal from an external of the refrigerator, and outputting data acquired from the broadcast signal, and a first controller for receiving the data output from the broadcast receiver, and outputting the received data to the first display, to enable the first display to output the data, and a second display unit including a second display, the storage unit, and a second controller for receiving the data from the first controller, and controlling the storage unit to store at least one of the refrigerator status data or the data received from the first controller, or outputting the at least one data to the second display.

The second display unit can display an avatar representing the status of the refrigerator.

Preferably, the second controller sends the data output through or stored in the second display unit to the first display unit. Preferably, the first controller receives the data sent from the second display unit, and outputs the received data to the first display.

The second controller may request the first display unit to send desired data. In this case, the first controller receives the data request, and sends the requested data to the second display unit in response to the data request.

The second display unit may send the avatar data to the first display unit, and the first display unit may output the received avatar data.

The second controller of the second display unit may receive a channel select command from a user, and send a channel select signal corresponding to the channel select command to the first display unit.

The first controller of the first display unit may selectively output at least one of the broadcast signal data and the data received from the second display unit. In this case, when the first controller receives the data from the second display unit during the outputting of the broadcast signal data, the first controller stops the outputting of the broadcast signal data, and performs the outputting of the received data.

When the first controller receives a broadcast signal of a single channel, the first controller may simultaneously output the received broadcast signal to a plurality Of screens.

When the first controller receives broadcast signals if a plurality of channels, the first controller may output the received broadcast signals to the multiple screens, respectively. In this case, preferably, when the first controller receives the data from the second display unit during the outputting of the broadcast signal data, the first controller stops the outputting of the broadcast signal data to at least one of the screens, and performs the outputting of the received data to the screen associated with the stopped data outputting.

When the first controller receives the data from the second display unit during the outputting of the broadcast signal data, the first controller may stop the outputting of the broadcast signal data to an overall screen region of the first display, and may output the received data to the overall screen region of the first display.

For example, the first controller of the first display unit may simultaneously output broadcast signals of four channels to one main screen and three sub-screens. In this case, the first controller of the first display unit enables the data received from the second display unit to be displayed on at least one of the four screens.

Preferably, the first controller is able to change the broadcast signal data output to one screen with the broadcast signal data output to another screen.

When the second controller receives a screen select command from a user, it may generate a screen select signal corresponding to the screen select command, and send the screen select signal. The first controller may select the broadcast signal data or the data received from the second controller in accordance with the screen select signal, to enable the selected data to be displayed on a selected one of the main screen and the sub-screens.

In accordance with another aspect, the present invention provides a refrigerator comprising: a refrigerator body; a display unit provided at the refrigerator body; and n external-appliance connector provided at the refrigerator body, and adapted to perform transmission and reception of data with an external appliance and with the display unit, wherein the display unit includes: a display for displaying various data; and a controller for controlling the data transmission and reception.

Advantageous Effects

Once the refrigerator according to the present invention can transmit and receive various data with an external appliance, it is possible to use the external appliance without using an additional device, and to edit data received from the external appliance.

In the refrigerator according to the present invention, a plurality of display units can share data, to output and edit the shared data. Accordingly, it is possible to improve the convenience of the user.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Figure 1:
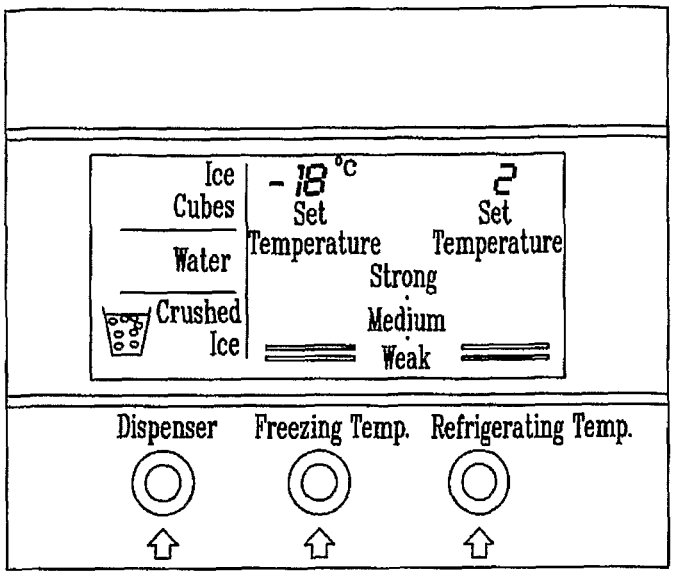
FIG. 1 is a schematic view illustrating a display included in a conventional refrigerator.

Reference will now be made in detail to the preferred embodiments of the present invention, examples of which are illustrated in the accompanying drawings.

The overall configuration of a refrigerator according to an exemplary embodiment of the present invention will be described with reference to FIGS. 2 and 3.

The refrigerator according to this embodiment includes a refrigerator body 10, a multi-display unit 100 including a plurality of display units provided at a door or doors of the refrigerator, and an external-appliance connector 46 for performing transmission and reception of data with an external electric appliance.

In this embodiment, the multi-display unit 100 includes a first display unit 30 and a second display unit 40.

The refrigerator body 10 includes a freezing compartment and a refrigerating compartment which extend vertically in parallel. A freezing compartment door 20*a* and a refrigerating compartment door 20*b* are mounted to the refrigerator body 10, to open or close the freezing and refrigerating compartments, respectively. A dispenser 11 is mounted in a recess formed in a front surface of the freezing compartment door 20*a*, together with the second display unit 40. The first display unit 30 is mounted in a recess formed in a front surface of the refrigerating compartment door 20*b*. Although not shown, both the first display unit 30 and the second display unit 40 may be installed at one of the freezing compartment door 20*a* and refrigerating compartment door 20*b*.

A compressor (not shown), a condenser (not shown), expansion means (not shown), an evaporator (not shown), etc. are arranged in a desired portion of the refrigerator body 10.

A voltage supplier 14 is also provided at the refrigerator body 10. The voltage supplier 14 receives a voltage from an external voltage source 12, and supplies the received voltage after stepping down the received voltage to a predetermined operating voltage.

The configuration of the display unit 100 will be described with reference to FIG. 3. The configuration of the first display unit 30 will first be described, and the configuration of the second display unit 40 will then be described.

The first display unit 30 includes a first connector 31 connected to the second display unit 40 via a data cable 50, a first display 32 for displaying image data, a first audio output unit 33 for outputting audio data, a first input unit 36 for acquiring an input for image and audio data from the user, and a broadcast receiver 34 for receiving broadcast signals via an antenna 35, and transmitting a selected one of the received broadcast signals corresponding to a predetermined channel to a first controller 37.

The first controller 37 is also included in the first display unit 30. The first controller 37 controls transmission and reception of various data.

The first connector 31 is a kind of interface means, and is connected to the second display unit 40 via the data cable 50. The data cable 50 may be embedded in the doors 20*a* and 20*b* or in the interior of a top wall of the refrigerator body 10.

The first display 32 functions to display various image data. Taking into consideration the thickness of the refrigerating compartment door 20*b*, the first display 32 is preferably configured by a thin film display device (for example, a liquid crystal display (LCD)).

The first audio output unit 33 functions to output an audio signal. Generally, a speaker is used for the first audio output unit 33. Although the first audio output unit 33 is typically arranged near the first display 32, it may be arranged at a different position, depending on the applied design condition.

The first input unit 36 functions to receive commands from the user associated with processing of various data, and to send the received commands to the first controller 37.

The first input unit 36 may be configured in the form of certain buttons, or may be a device capable of receiving a signal (for example, an infrared signal) from a remote controller (not shown). Using the first input 36, selection of a desired channel, selection of a desired audio output level, etc. may be performed.

The broadcast receiver 34 not only receives broadcast signals, but also receives a channel select signal from the first input unit 36 or second display unit 40 via the first controller 37. The broadcast receiver 34 detects a broadcast channel corresponding to the received channel select signal, and sends a broadcast signal of the detected broadcast channel to the first controller 37. The channel select signal may include selection of one channel or multiple channels. Accordingly, when the channel select signal selects a plurality of channels, the broadcast receiver 34 sends the broadcast signals respectively corresponding to all the selected channels to the first controller 37.

Here, the broadcast signals may include over-the-air broadcast signals, cable broadcast signals, digital multimedia broadcasting (DMB) broadcast signals, etc.

Figure 2:
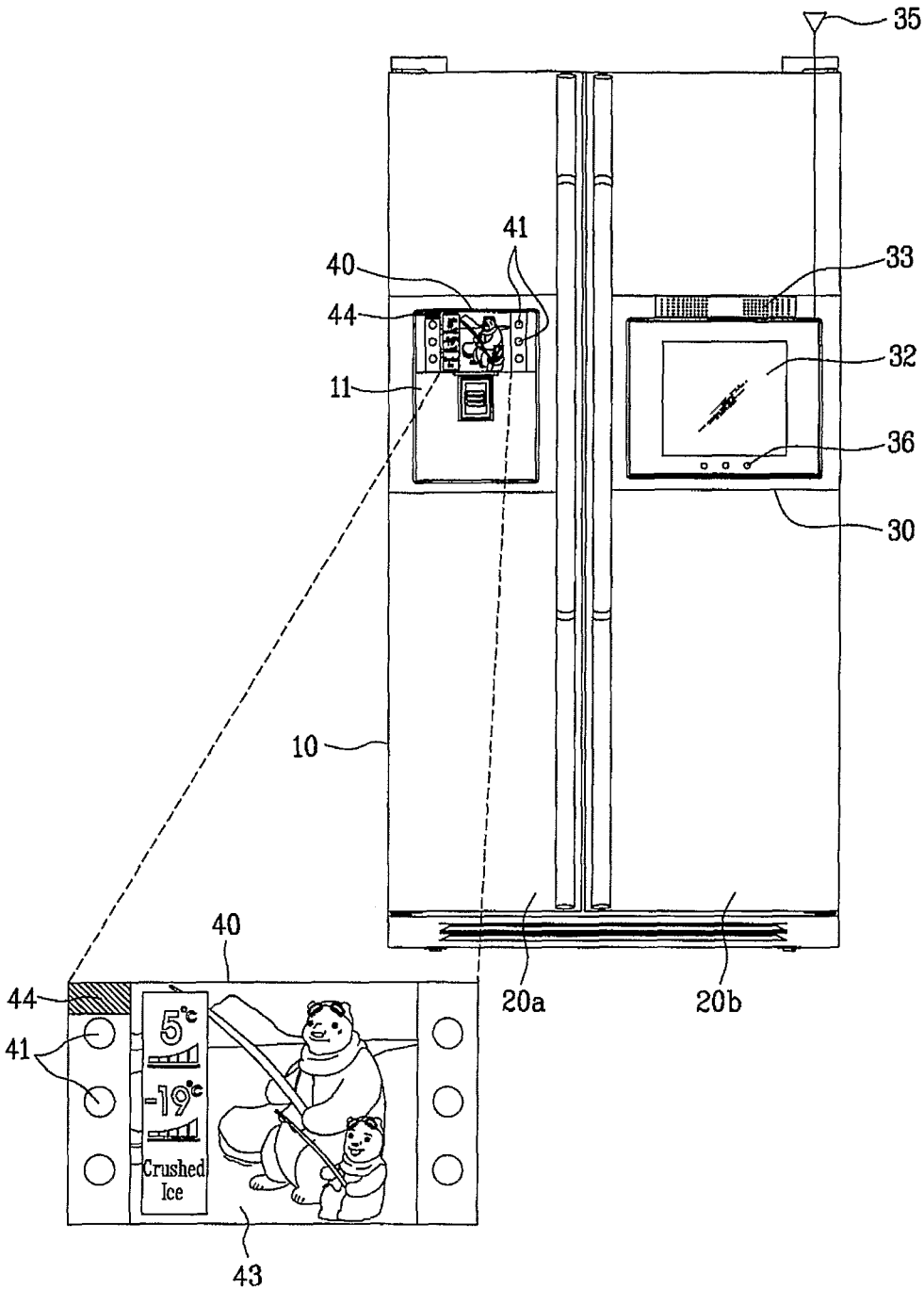
FIG. 2 illustrates a refrigerator including display units according to the present invention, through a front view and a partial enlarged view.
Figure 3:
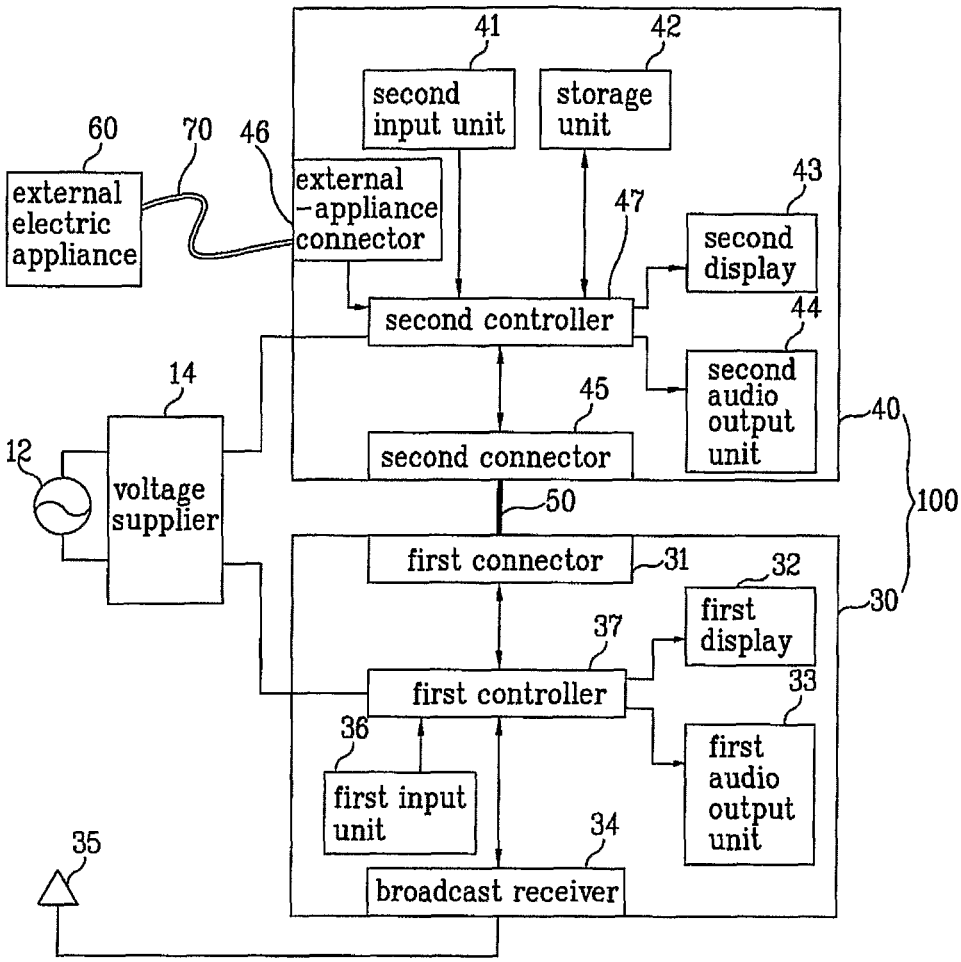
FIG. 3 is a block diagram illustrating configurations of the display units according to the present invention.

As shown in FIG. 2, the antenna 35 is preferably externally exposed through a hinge hole (not shown) formed at the refrigerating compartment door 20*b*. However, the antenna 35 may be arranged in the interior of the refrigerating compartment door 20*b* or near the first display unit 30, depending on the performance and characteristics of the antenna 35.

The first controller 37 functions to control data transmission and reception between the display units of the multi-display unit 100. For example, the first controller 37 sends image and audio data to the first display 32 or audio output unit 33, in order to enable the image and audio data to be output. The first controller 37 also receives a broadcast signal of a specific channel from the broadcast receiver 34, and sends data acquired from the received broadcast signal to the first display 32 or first audio output unit 33.

In particular, the first controller 37 may receive a broadcast signal of a specific channel from the broadcast receiver 34, acquires video data or audio data from the received broadcast signal, and displays the acquired video data or audio data.

Upon receiving a single-channel broadcast signal, the first controller 37 displays video data acquired from the received broadcast signal on the overall region of the screen without any problem. However, when the first controller 37 receives broadcast signals of multiple channels, it is preferred that the first controller 37 display video data pieces respectively acquired from the received broadcast signals, through one main screen and a plurality of sub-screens. In this multi-channel display, the video data pieces of multiple channels may be initially displayed in accordance with an initially-set reference (for example, displaying the video data piece of the lowest channel No. on the main screen, and displaying the video data pieces of the remaining channels on the sub-screens, respectively). In this case, it is preferred that the first controller 37 output the audio data corresponding to the video data displayed on the main screen, through the first audio output unit 33. The screen division method will be described in detail later.

The first controller 37 may receive audio data from the second display unit 40 via the first connector 31. The audio data may be mono audio data or stereo audio data. The first controller 37 sends the received audio data to the first audio output unit 33 without any additional processing, in order to enable the audio signal to be output through the first audio output unit 33.

When the first controller 37 receives an alarm signal from the second display unit 40 while currently receiving a TV broadcast signal and performing a control operation to display the received TV broadcast signal through the first display 32 and first audio output unit 33, the first controller 37 may stop sending of at least one of the video data and audio data of the received TV broadcast signal to the first display 32 or first audio output unit 33, in response to the received alarm signal, and may send the alarm signal to the first display 32 or first audio output unit 33 not receiving the video data or audio data, to enable the alarm signal to be output.

On the other hand, when the first controller 37 receives an alarm signal under the condition in which the first controller 37 does not currently perform a control operation to output a broadcast signal, or is in a standby state, the first controller 37 may send the alarm signal to the first display 32 or first audio output unit 33 without performing any additional control operation.

In addition to the unction to receive a broadcast signal of a specific broadcast channel from the broadcast receiver 34, to acquire video data and audio data from the received broadcast signal, and to perform a control operation to display the acquired video data and audio data, the first controller 37 has a function to receive a command (for example, an image data request command) from the second display unit 40 via the first connector 31, and to perform a control operation according to the received command.

In particular, when the first controller 37 receives a data request command from the second display unit 40, it may transmit data currently output from the first display 32 or first audio output unit 33 to the second display unit 40 via the first connector 31, in accordance with the data request command. The transmitted data may include one of the images successively displayed on the first display 32, namely, a still image.

Next, a screen division function of the first controller 37 will be described with reference to FIGS. 3 and 4.

Figure 4:
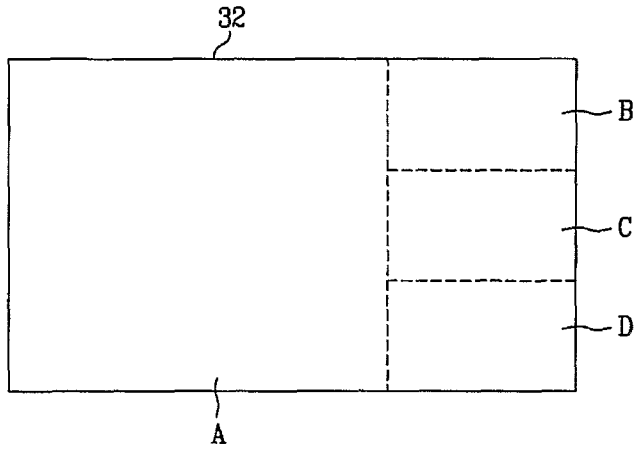
FIG. 4 is a schematic view illustrating division of a display included in one display unit according to the present invention into a plurality of screens.

As shown in FIG. 4, the first display 32 may be divided into a main screen A and three sub-screens B, C, and D. In this case, the first controller 37 may control the first display 32 to display video data pieces respectively corresponding to fourth channels on the main screen A and three sub-screens B, C, and D.

The first controller 37 may also receive image data from the second display unit 40, and display the received image data on one of the main screen A and sub-screens B, C, and D. In this case, the first controller 37 controls one of the main screen A and sub-screens B, C, and D to stop display of broadcast-channel video data, and then to display the image data received from the second display unit 40. Alternatively, the first controller 37 may control the first display 32 to display the received image data on the overall screen region. That is, the first controller 37 may control the first display 32 to simultaneously display the video data of the received broadcast signal and the image data received from the second display unit 40, or to selectively display one of the video data and image data.

However, the first controller 37 performs display control such that the image data received from the second display unit 40 is displayed on the overall screen region or on one of the main screen A and sub-screens B, C, and D, preferentially to the currently displayed video data.

That is, it is preferred that the first controller 37 enable the image data received from the second display unit 40 to be displayed on the first display unit 32 in a screen size larger than that of the second display unit 43 included in the second display unit 40, in order to allow the user to perform a function for enlarging the display size of the image data.

Where the first controller 37 has a function to receive various data from the second display unit 40 and to perform a control operation to display the received data on one of the main screen A and sub-screens B, C, and D, as described above, the received data may be avatar data representing the status of the refrigerator.

In this case, it is preferred that one of the main screen A and sub-screens B, C, and D stop display of broadcast-channel video data, and then display the data received from the second display unit 40.

The first controller 37 may also control the first display 32 to change the main screen A and the sub-screen B, C, or D with each other, in accordance with a screen select input from the first input unit 36 or a screen select signal from the second display unit 40. For example, when the user inputs a screen select input or screen select signal under the condition in which video data of a music channel is displayed on the main screen A, and video data of a sport channel is displayed on the sub-screen B, C, or D, screen change is made in accordance with the screen select input or screen select signal such that the video data of the sport channel is displayed on the main screen A, and the video data of the music channel is displayed on the sub-screen B, C, or D. Thus, the screen select input and screen select signal are used to select video data or avatar data to be displayed on the main screen A.

In accordance with the data request command from the second display unit 40, the first controller 37 sends data of a channel (broadcast) corresponding to the data request command to the second display unit 40. The data may be video data or audio data. Both the video data and the audio data may be requested.

The data request command is used to request the first controller 37 to send the video data of a selected one if the channels currently displayed on the first display 32 to the second display unit 40. In accordance with this data request command, data displayed on the main screen A or the sub-screen B, C, or D may be sent. Accordingly, the same data may be displayed on both the first display 32 and the second display 43, using the data request command.

Next, the configuration of the second display unit 40 will be described.

Referring to FIGS. 2 and 3 again, the second display unit 40 includes a second input unit 41 for receiving a command from the user, a storage unit 42 for storing various data, a second display 43 for displaying various data, a second audio output unit 44 for outputting audio data, and a second connector 45 for performing transmission and reception of data with the first connector 31. The external-appliance connector 46, which performs transmission and reception of various data with the external electric appliance, is also included in the second display unit 40. The second display unit 40 further includes a second controller 47 for controlling data transmission and reception carried out among the above-described constituent elements.

A main controller (or main microcomputer) (not shown) may be further provided at the refrigerator body 10. The main controller may directly perform control operations associated with refrigerating and freezing operations. A communication line may be connected between the main controller and the second controller 47, for implementation of data communication. The control operations associated with the refrigerating and freezing operations may be carried out directly through the second controller 47.

The second input unit 41 is adapted to receive commands from the user (for example, a command for transmission of various data to the first display unit, a command for service mode selection of the dispenser, a channel select command, a screen select command, an image data display command, a command for allowance of data reception, an alarm command, a data sharing command, a sound output mode select command, a data storing command, and a data editing command). The second input unit 41 may be configured in the form of an appropriate number of buttons, or a touch pad.

The command for transmission of various data to the first display unit is adapted to request transmission of received data or stored data to the first display unit 30 via the second connector 45.

For example, in accordance with this command, avatar data, which is currently displayed on the second display 43 of the second display unit 40, may be sent to the first display unit 30 so that the sent avatar data may be displayed on the main screen A or sub-screen B, C, or D of the first display 32 in accordance with operation of the first display unit 30.

The channel select command is adapted to select broadcast channels desired to be displayed on the first display 32 of the first display unit 30. For example, the channel select command may include channel select information for selection of four channels.

The screen select command is adapted to change the display size of the channel displayed on the first display 32 of the first display unit 30. That is, the screen select command is adapted for channel change between the main screen A and the sub-screen B, C, or D.

The image data display command is associated with a function for sequentially or simultaneously displaying the image data stored in the storage unit 42. The storage unit 42 stores at least one image data piece. In accordance with the image data display command, the image data pieces stored in the storage unit 42 are sequentially displayed, one by one, on the second display 43, or are simultaneously displayed on the second display 43.

The command for allowance of data reception is adapted to allow reception of data when the second display 43 displays, under the control of the second controller 47, the fact that the external electric appliance can transmit data via the external-appliance connector 46.

The alarm command is generated from the second controller 47 when the second controller 47 receives data, to request the first display unit 30 to output the received data through the first display 32 or first audio output unit 33.

For example, the alarm command may be executed when the second controller 47 receives data via the external-appliance connector 46, when the data representing the status of the refrigerator is changed, or when the second controller 47 receives data from the first display unit 30 via the second connector 45.

In particular, the alarm command is more useful when the first display unit 30 controls the first display 32 and first audio output unit 33, based on a broadcast signal. In accordance with the alarm command, the first controller 37 may perform a control operation to stop outputting of at least one of the video data and audio data of the broadcast signal, and to enable outputting of data associated with the alarm command.

The data sharing command is adapted to additionally send the image or audio data currently outputted through the first display unit 30 to the second display 43 or second audio output unit 44 of the second display unit 40, in order to additionally output the data through the second display 43 or second audio output unit 44.

Conversely, in accordance with the data sharing command, the image data currently displayed on the second display 43 of the second display unit 40 may be sent to the first display unit 30 via the second connector 45 so that the image data may be displayed on the main screen A or sub-screen B, C, or D of the first display unit 30, or on the overall screen region of the first display unit 30.

The image data may include an image such as a figure image or a landscape image photographed by a camera (not shown) built in the second display unit 40 or acquired from the external electric appliance.

The sound output mode select command is adapted to output audio data in a stereo fashion in accordance with the relative positions of the first audio output unit 33 and second audio output unit 44 when the audio data includes stereo sounds (for example, a left sound, a right sound, etc.).

The data storing command is adapted to store a selected one of images desired by the user while the user views the images displayed on the first display 32 of the first display unit 30. The second controller 47 may receive the image data of the selected image from the first display unit 30, and store the received image data in the storage unit 42. Otherwise, the second controller 47 may send the image data to the second display 43, to enable the image data to be displayed.

The data editing command is a command input by the user via the second input unit 41 when an edition such as correction (color change, display size change, etc.), deletion, addition of another image, and addition of text is executed for the image of the image data received from the first display unit 30 and displayed on the second display 43.

In particular, when an avatar or other background image is currently displayed under the control of the second controller 47, the user may set desired image data (image data received from the first display unit 30, edited image data, etc.) through the second input unit 41, as a background image.

The storage unit 42 stores avatar information as to avatar characters and information as to the status of the refrigerator therein.

The avatar information includes data as to a plurality of avatar characters, in order to enable the status of the refrigerator to be represented through an avatar such that the user can easily identify the status of the refrigerator.

The avatar characters may be configured in the form of a still image or a moving image, or may be configured in the form of an animation. The avatar characters are set by the user or by the second controller 47. One or multiple avatar characters are displayed on the second display 43 in accordance with a reading operation of the second controller 47.

The storage unit 42 also stores user interfaces for setting of an avatar, setting of a background image, edition of data, etc. therein, in order to enable the user to easily perform the above-described setting operation, together with the second input unit 41.

The storage unit 42 may also store data received by the second controller 47 via the external-appliance connector 46.

The refrigerator status information includes the freezing and refrigerating compartment temperatures set by the user or by the manufacturer, the service mode of the dispenser, ice information, and the kinds and amounts of stored foods.

Preferably, the second display 43 is mounted to the front surface of the freezing compartment door 20*a*. The second display 43 displays received data or stored data.

For example, the second display 43 may display avatar characters, user interfaces as described above, the current service mode of the dispenser, and the set freezing and refrigerating compartment temperatures, etc.

The second audio output unit 44 not only outputs received or stored audio data, but also outputs a predetermined alarm sound in accordance with the status of the refrigerator.

For example, when the freezing compartment door 20*a* is maintained in an opened state for a predetermined time or more, an alarm sound set by the user through the second input 41 is output.

The second connector 45 is an interface connected to the data cable 50 for communication with the first connector 31 of the first display unit 30. That is, the second connector 45 enables data communication between the first display unit 30 and the second display unit 40.

The above-described first connector 31 and second connector 45 are not limited to wire communication. They may perform wireless communication without using the data cable 50. For example, Bluetooth communication, radio frequency (RF) communication, or infrared (IR) communication may be used.

Basically, the second controller 47 performs a function to control data transmission and reception for the data stored in the second display unit 40 or the data received by the second display unit 40.

For example, the second controller 47 receives commands associated with the control of the refrigerator through the second input unit 41, to execute freezing and refrigeration control operations. The second controller 47 also reads information as to a background image and avatar characters, and refrigerator control information from the storage unit 42, and controls the second display 43 to display the read information.

Also, the second controller 47 receives, from the second input unit 41, a channel select command for selecting a desired one of the channels associated with the data displayed on the first display unit 32 of the first display unit 30, and generates a corresponding channel select signal. The second controller 47 sends the channel select signal to the first display unit 30 via the second connector 45, so as to enable the video or audio data of single or multiple channels desired by the user to be output through the first display unit 32 or first audio output unit 33.

In addition, the second controller 47 performs transmission and reception of data with the external electric appliance 60, via the external-appliance connector 46. The data transmission and reception may be carried out in accordance with a unilateral data transmission from the external electric appliance 60. Alternatively, the data transmission and reception may be carried out in accordance with a request sent from the second controller 47 to the external electric appliance 60. When such a request is made, the second controller 47 controls the second display 43 to display the request. When the user inputs a command for allowance of data transmission and reception via the second input unit 41, the second controller 47 allows the data transmission and reception.

The second controller 47 may also send the received data to the first display unit 30 via the second connector 45, so as to enable the received data to be output. At this time, the second controller 47 sends the data, together with a data sharing command as described above. In addition, the second controller 47 may control the second display 43 of the second display unit 40 to output the same data as that of the first display unit 30, in an automatic manner or in response to a data output select command from the user received via the second input unit 41.

When the received audio signal is of a stereo sound type, it is generally constituted by a left sound and a right sound. In this case, the second controller 47 receives a sound output mode select command from the user via the second input unit 41. In response to the received command, the second controller 47 adjusts the distribution of the left and right sounds of the audio signal in accordance with the positions of the first and second audio output units 33 and 44, in order to enable the left and right sounds to be output through the first and second audio output units 33 and 44, respectively.

For example, where the second audio output unit 44 of the second display unit 40 is arranged at the left side, and the first audio output unit 33 of the first display unit 30 is arranged at the right side, as shown in FIG. 2, the second controller 47 sends an audio signal consisting of a strong left sound and a weak right sound to the second audio output unit 44, and sends an audio signal consisting of a weak left sound and a strong right sound to the first display unit 30, to enable the different audio signals to be output through the first and second audio output units 33 and 44. Thus, audio signal reproduction in a stereo mode is achieved.

Figure 7:
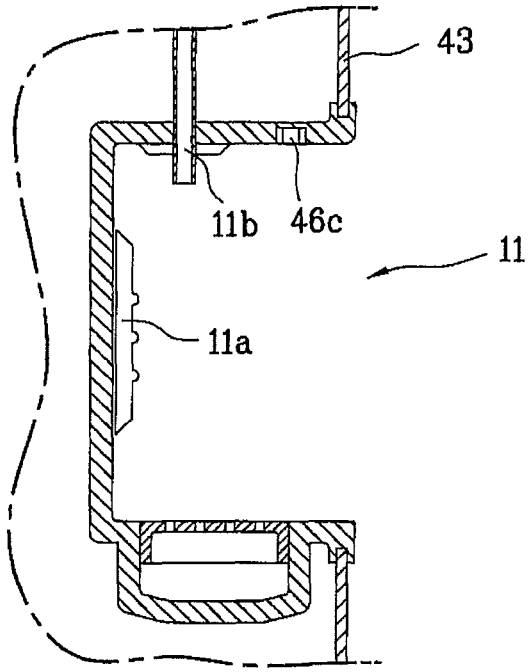
FIG. 7 is a sectional view illustrating a modification of the external-appliance connector according to the present invention.

When the second controller 47 receives a data sharing command from the second input unit 41, it reads image data currently displayed on the second display 43 from the storage unit 42, and sends the read image data to the first display unit 30 via the second connector 45, to enable the first display unit 30 to display the image data on the main screen A or sub-screen B, C, or D of the first display 32 or on the overall screen region of the first display 32 (FIG. 7). The image data, which is sent from the second controller 47 to the first display unit 30, may be controlled by the second controller 47 to have a priority in terms of the data processing order, to enable the first display unit 30 to display the image data preferentially to other image data.

When the second controller 47 receives a data storing command from the second input unit 41, it generates a data request command in response to the data storing command, and sends the data request command to the first display unit 30 via the second connector 45. The second controller 47 subsequently receives data sent from the first display unit 30 in response to the data request command, via the second connector 45, and stores the received data in the storage unit 42. The second controller 47 also displays the data, or outputs the data through the second audio output unit 44.

When the second controller 47 receives a data editing command input by the user for edition of data, via the second input unit 41, it reads a user interface required for the edition of data from the storage unit 42. The second controller 47 then outputs the read user interface, together with data to be edited, through the second display 43 or second audio output unit 44.

Subsequently, the second controller 47 receives a series of commands associated with the edition of data from the user, and outputs data edited in accordance with the commands through the second display 43 or second audio output unit 44. When the second controller 47 finally receives a command for storing the edited data, it stores the edited data in the storage unit 42.

When the second controller 47 receives a command input by the user for setting of the background image, via the second input unit 41, it reads avatar information, image data information, or background image information from the storage unit 42, and controls the second display 43 to display the read information. Subsequently, the second controller 47 stores an image (avatar, image data, etc.) selected by the user under the condition in which the selected image is included in the background image information, and controls the second display 43 to display the selected image.

The external-appliance connector 46 is an interface for performing data transmission and reception with the external electric appliance 60 via the data cable 70. Here, the external appliance 60 may include an MP3 player, a CDP, a PMP, a digital camera, etc. Also, personal portable terminals and mobile phones having functions associated with the MP3 player, CDP, PMP, digital camera, etc. may be collectively included in the external appliance 60.

The external-appliance connector 46 is not limited to wire communication. The external-appliance connector 46 may perform wireless communication such as IR communication, Bluetooth communication, or RF communication.

The external-appliance connector 46 may be arranged at various positions of the refrigerator body 10.

Another embodiment of the external-appliance connector 46 will be described with reference to FIGS. 5 to 7.

Figure 5:
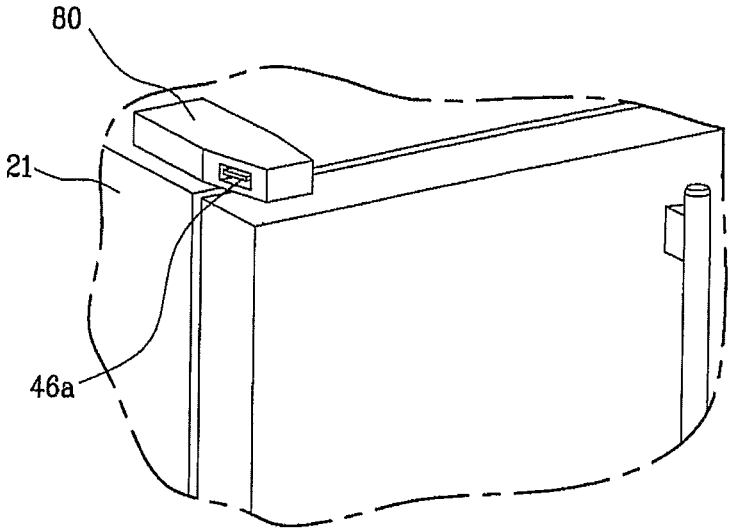
FIG. 5 is a perspective view illustrating an external-appliance connector according to the present invention.

Referring to FIG. 5, an external-appliance connector 46*a* is mounted in a hinge cover 80 attached to the freezing compartment door 20*a*. Although not shown, the data cable between the external-appliance connector 46*a* and the second controller 47 extends through a hinge hole formed through the freezing compartment door 30*a*. As the external-appliance connector 46*a* is installed at the above-described position, it is possible to prevent babies from having access to the external-appliance connector 46*a*, and thus, to prevent the external-appliance connector 46*a* from being damaged, while allowing the user to use the external-appliance connector 46*a*.

Figure 6:
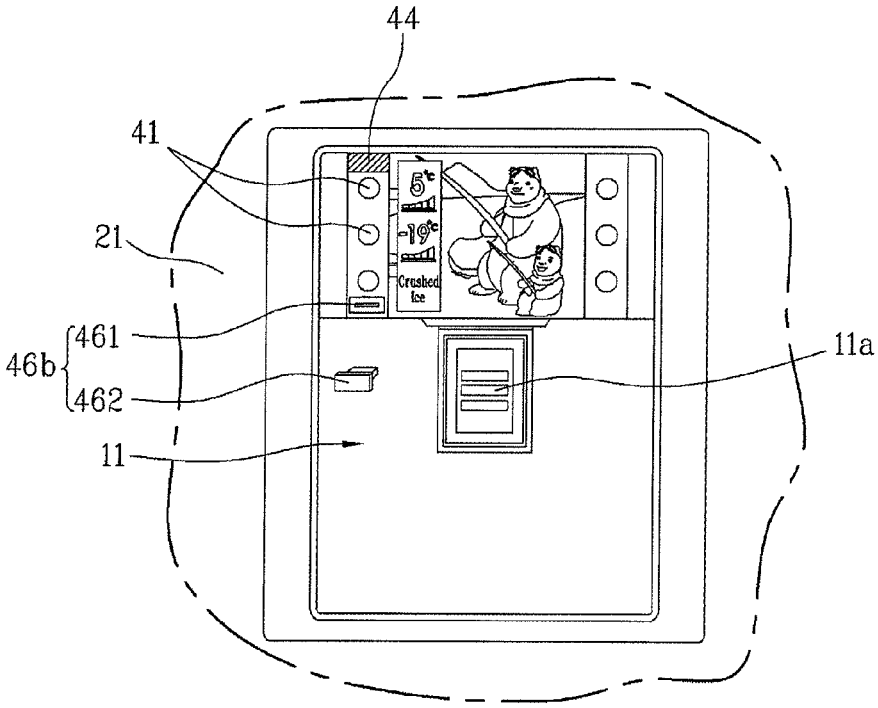
FIG. 6 is a front view illustrating the display of a second display unit according to the present invention.

Referring to FIG. 6, an external-appliance connector 46*b* is arranged near the second display 43. In this case, it is possible to easily enable the user to have access to the external-appliance connector 46*b*. Since the external-appliance connector 46*b* is positioned above the dispenser 11, it is possible to prevent babies from having access to the external-appliance connector 46*b*.

Referring to FIG. 7, an external-appliance connector 46*c* is arranged at the top of the dispenser 11 while being positioned in front of an outlet 11*b* of the dispenser 11. In this case, the user can easily access the external-appliance connector 46*c*.

Since the external-appliance connector 46*c* is arranged inside the dispenser 11, it is also possible to prevent babies from having access to the external-appliance connector 46*c*.

In the case of FIG. 6 or 7, the distance between the external-appliance connector 46*b* or 46*c* and the second controller 47 is short. Accordingly, it is possible to reduce the length of the cable connecting the external-appliance connector 46*b* or 46*c* and the second controller 47.

Since moisture or dust may penetrate into the external-appliance connector 461, a rubber cap 462 may be mounted to prevent such moisture or dust penetration. The rubber cap may have a structure in which the rubber cap has an end fixed to the refrigerator, or may have a structure in which the rubber cap is completely separable from the refrigerator.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The present invention provides a refrigerator having a data transmission/reception function, to achieve an improvement in the convenience of the user.

Since the refrigerator according to the present invention can transmit and receive various data with an external appliance, it is possible to use the external appliance without using an additional device, and to edit data received from the external appliance.

In the refrigerator according to the present invention, a plurality of display units can share data, to output and edit the shared data. Accordingly, it is possible to improve the convenience of the user.

The invention claimed is:

1. A refrigerator comprising:

a refrigerator body;

doors mounted to the refrigerator body to open or close the refrigerator body;

a hinge cover attached to at least one of the doors;

a dispenser mounted in a recess formed in a front surface of one of the doors;

a plurality of display units provided at the doors, one of the plurality of display units being adjacent to the dispenser;

an external-appliance connector mounted in the hinge cover and on the display unit adjacent to the dispenser; and a data cable extending from the external-appliance connector to one of the display units;

wherein each of the display units includes:

a display for displaying data including an image or audio data, or data as to a status of the refrigerator;

a connector for performing transmission and reception of the data or a command with the remaining display units; and a controller for controlling the data transmission and reception via the connector, wherein the controller is configured to display the data and to perform a control operation according to the command, wherein the external-appliance connector is configured to perform transmission and reception of data with an external appliance, and wherein the external-appliance connector comprises:

a connecting jack connected with the external appliance; and a rubber cap for sealing the connecting jack.

2. The refrigerator according to claim 1, wherein at least one of the display units further includes an input unit for receiving a command from a user.

3. The refrigerator according to claim 1, wherein the refrigerator body includes a cap for protecting the external-appliance connector.

4. The refrigerator according to claim 1, wherein at least one of the display units further includes an audio output unit for receiving an audio signal via the external-appliance connector, and outputting the audio signal.

5. The refrigerator according to claim 4, wherein each of the display units includes an audio output unit, and the controller adjusts distribution of sound components of the audio signal such that the audio signal is output through the audio output units in a stereo fashion.

6. The refrigerator according to claim 1, wherein at least one of the display units further includes a storage unit for storing the image or audio data, or data as to a status of the refrigerator.

7. The refrigerator according to claim 6, wherein the controller of the display unit including the storage unit selectively outputs at least one of the stored data.

8. The refrigerator according to claim 6, wherein the controller of the display unit including the storage unit has a function to edit the stored data.

9. The refrigerator according to claim 8, wherein the controller has a function to set the stored image data as a background image.

10. The refrigerator according to claim 6, wherein the plurality of display units comprise:

a first display unit including a first display, a broadcast receiver for receiving a broadcast signal from an external of the refrigerator, and outputting data acquired from the broadcast signal, and a first controller for receiving the data output from the broadcast receiver, and outputting the received data to the first display, to enable the first display to output the data; and a second display unit including a second display, the storage unit, and a second controller for receiving the data from the first controller, and controlling the storage unit to store at least one of the refrigerator status data or the data received from the first controller, or outputting the at least one data to the second display.

11. The refrigerator according to claim 10, wherein the second controller controls the storage unit to store avatar information representing the status of the refrigerator, and controls the second display to selectively display the avatar information.

12. The refrigerator according to claim 11, wherein:

the second controller sends the refrigerator status data or the avatar information to the first display unit in accordance with a predetermined data sharing command;

the first controller receives the data sent from the second display unit, and outputs the received data to the first display.

13. The refrigerator according to claim 12, wherein the first controller selectively outputs at least one of the broadcast signal data and the data received from the second display unit.

14. The refrigerator according to claim 12, wherein, when the first controller receives the data from the second display unit during the outputting of the broadcast signal data, the first controller stops the outputting of the broadcast signal data, and performs the outputting of the received data.

15. The refrigerator according to claim 10, wherein:

the second controller requests the first display unit to send desired data; and the first controller receives the data request, and sends the requested data to the second display unit in response to the data request.

16. The refrigerator according to claim 10, wherein the second controller receives a channel select command from a user, and sends a channel select signal corresponding to the channel select command to the first display unit.

17. The refrigerator according to claim 12, wherein:

the first display is dividable into a main screen and a plurality of sub-screens; and when the first controller receives a broadcast signal of a single channel, the first controller simultaneously outputs the received broadcast signal to the main screen and the sub-screens.

18. The refrigerator according to claim 12, wherein:

the first display is dividable into a main screen and a plurality of sub-screens; and when the first controller receives broadcast signals of a plurality of channels, the first controller outputs the received broadcast signals to the main screen and the sub-screens, respectively.

19. The refrigerator according to claim 18, wherein, when the first controller receives the data from the second display unit during the outputting of the broadcast signal data, the first controller stops the outputting of the broadcast signal data to at least one of the main screen and the sub-screens, and performs the outputting of the received data to the screen associated with the stopped data outputting.

20. The refrigerator according to claim 18, wherein, when the first controller receives the data from the second display unit during the outputting of the broadcast signal data, the first controller stops the outputting of the broadcast signal data to an overall screen region of the first display, and outputs the received data to the overall screen region of the first display.

21. The refrigerator according to claim 18, wherein the first controller is able to change the broadcast signal data output to the main screen with the broadcast signal data output to one of the sub-screens.

22. The refrigerator according to claim 18, wherein:

the second controller receives a screen select command from a user, generates a screen select signal corresponding to the screen select command, and sends the screen select signal; and the first controller selects the broadcast signal data or the data received from the second controller in accordance with the screen select signal, to enable the selected data to be displayed on a selected one of the main screen and the sub-screens.

23. The refrigerator according to claim 18, wherein the external-appliance connector is configured to perform wireless transmission and reception of data with an external appliance.

* * * * *